US009970733B2

(12) United States Patent
Christopher et al.

(10) Patent No.: US 9,970,733 B2
(45) **Date of Patent: *May 15, 2018**

(54) PAINTBALL LOADER

(71) Applicant: GI SPORTZ DIRECT LLC, Sewell, NJ (US)

(72) Inventors: James T. Christopher, Sachse, TX (US); Chris T. Goddard, Aubrey, TX (US)

(73) Assignee: GI SPORTZ DIRECT LLC, Sewell, NJ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/478,608

(22) Filed: Apr. 4, 2017

(65) Prior Publication Data

US 2017/0268847 A1 Sep. 21, 2017

Related U.S. Application Data

(63) Continuation of application No. 14/968,499, filed on Dec. 14, 2015, now abandoned, which is a (Continued)

(51) Int. Cl.
*F41B 11/53* (2013.01)
*F41B 11/57* (2013.01)

(52) U.S. Cl.
CPC ..... *F41B 11/53* (2013.01); *F41B 11/57* (2013.01)

(58) Field of Classification Search
CPC ..... F41B 11/58; F41B 11/51; F41B 11/52; F41B 11/53; F41B 11/57; A63B 47/002; A63B 69/409

(Continued)

(56) References Cited

U.S. PATENT DOCUMENTS 1,332,992 A 3/1920 Moore et al.
1,332,993 A 3/1920 Moore et al.

(Continued)

FOREIGN PATENT DOCUMENTS

CA 2625799 1/2011
DE 876370 5/1953

(Continued)

OTHER PUBLICATIONS

WARPIG—World And Regional Paintball Information Guide, http://www.warpig.com/paintball/technical/loaders/halo/index.shtml, warpig.com, Odyssey Readies Halo for Production, By Bill Mills, Jun. 2001, pp. 1 to 6.

(Continued)

*Primary Examiner* — Bret Hayes
(74) *Attorney, Agent, or Firm* — Volpe and Koenig, P.C.

(57) ABSTRACT

A paintball loader for use on a paintball gun for feeding paintballs is provided. The paintball loader includes a container for holding a plurality of paintballs, a paintball agitator rotatably mounted in the container, the paintball agitator including at least two fins extending substantially perpendicular to the axis of rotation, the fins spaced apart from each other forming a gap therebetween large enough to accommodate more than one paintball. At least two paintballs are positioned in the gap between the fins. A motor is configured to rotate the paintball agitator. The container includes an exit tube exiting from the bottom portion of the container and leading to an inlet tube of the paintball gun. A microprocessor in communication with a sensor may also be provided for controlling the motor. A deflector for deflecting paintballs may also be provided, the deflector movably attached to the interior surface of the container.

16 Claims, 9 Drawing Sheets

Related U.S. Application Data continuation of application No. 14/058,589, filed on Oct. 21, 2013, now Pat. No. 9,212,864, which is a continuation of application No. 13/301,265, filed on Nov. 21, 2011, now Pat. No. 8,561,600, which is a continuation of application No. 12/040,119, filed on Feb. 29, 2008, now Pat. No. 8,061,342, which is a continuation of application No. 11/522,708, filed on Sep. 18, 2006, now abandoned, which is a continuation of application No. 10/851,837, filed on May 21, 2004, now abandoned, which is a continuation of application No. 09/949,440, filed on Sep. 7, 2001, now Pat. No. 6,792,933, which is a continuation-in-part of application No. 09/689,573, filed on Oct. 12, 2000, now Pat. No. 6,502,567, which is a continuation-in-part of application No. 09/465,440, filed on Dec. 16, 1999, now Pat. No. 6,213,110.

(58) Field of Classification Search
USPC ..... 124/45, 48, 49, 50, 51.1
See application file for complete search history.

(56) References Cited

U.S. PATENT DOCUMENTS 1,403,689 A 1/1922 Hyndman
1,403,719 A 1/1922 Szepe
1,404,689 A 1/1922 Fairweather
1,743,576 A 1/1930 Smith
1,867,513 A 7/1932 Lahti
1,954,093 A 4/1934 Nelson
2,064,888 A 12/1936 Dickinson
2,307,015 A 1/1943 Boynton
2,338,984 A 1/1944 Van Horn et al.
2,357,951 A 9/1944 Hale
2,398,263 A 4/1946 Trimbach
2,451,521 A 10/1948 Uglum
2,526,969 A 10/1950 Powers
2,568,432 A 9/1951 Cook
2,639,904 A 5/1953 McMaster et al.
2,641,412 A 6/1953 Byberg
2,676,633 A 4/1954 Lohre et al.
RE23,951 E 2/1955 Graham
2,716,973 A 9/1955 Desi
2,900,972 A 8/1959 Marsh et al.
3,089,476 A 5/1963 Wolverton
3,134,301 A 5/1964 Even
3,248,008 A 4/1966 Meierjohan
3,273,553 A 9/1966 Doyle
3,384,354 A 5/1968 Migule et al.
3,410,453 A 11/1968 Lawrence
3,467,073 A 9/1969 Rhodes
3,610,223 A 10/1971 Green
3,630,118 A 12/1971 Stoner
3,695,246 A 10/1972 Filippi et al.
3,724,437 A 4/1973 Halstead
3,745,687 A 7/1973 Koon, Jr.
3,766,901 A 10/1973 Cleary et al.
3,777,732 A 12/1973 Holloway et al.
3,788,298 A 1/1974 Hale
3,789,891 A 2/1974 Bosch
3,807,379 A 4/1974 Vodinh
3,814,283 A 6/1974 Cioth
3,844,267 A 10/1974 Mohr
3,855,988 A 12/1974 Sweeton
3,867,921 A 2/1975 Politzer
3,894,657 A 7/1975 Eckmayr
3,930,486 A 1/1976 Kahelin
3,978,841 A 7/1976 Yarur et al.
3,990,426 A 11/1976 Stokes
4,021,036 A 5/1977 Nelson et al.
4,027,646 A 6/1977 Sweeton
4,034,644 A 7/1977 Hupp et al.
4,044,290 A 8/1977 Gullo
4,073,280 A 2/1978 Koehn et al.
4,112,911 A 9/1978 Petrick, Sr.
4,116,192 A 9/1978 Scott
4,148,415 A 4/1979 Florida et al.
4,185,824 A 1/1980 Natwick
4,207,857 A 6/1980 Balka, Jr.
4,280,697 A 7/1981 Yuasa
4,299,383 A 11/1981 Yuasa
4,332,097 A 6/1982 Taylor, Jr.
4,391,264 A 7/1983 Abraham et al.
4,396,193 A 8/1983 Reinhardt et al.
4,481,862 A 11/1984 Wiethoff et al.
4,487,103 A 12/1984 Atchisson
4,502,455 A 3/1985 Stokes
4,563,999 A 1/1986 Miehlich
4,646,709 A 3/1987 Kholin
4,676,137 A 6/1987 Stockton et al.
4,695,954 A 9/1987 Rose et al.
4,745,842 A 5/1988 Shou-Fu
4,748,600 A 5/1988 Urquhart
4,759,435 A 7/1988 Cedrone
4,765,223 A 8/1988 Beckmann
4,770,153 A 9/1988 Edelman
4,817,955 A 4/1989 Hickson et al.
4,819,609 A 4/1989 Tippmann
4,834,060 A 5/1989 Greene
4,850,330 A 7/1989 Nagayoshi
4,896,646 A 1/1990 Kahelin et al.
4,923,066 A 5/1990 Ophir et al.
4,926,742 A 5/1990 Ma et al.
4,927,051 A 5/1990 Falk et al.
4,930,400 A 6/1990 Brandl et al.
4,936,282 A 6/1990 Dobbins et al.
4,951,548 A 8/1990 Wixon et al.
4,951,644 A 8/1990 Bon
4,965,951 A 10/1990 Miller et al.
4,986,251 A 1/1991 Lilley
4,993,400 A 2/1991 Fitzwater
5,042,685 A 8/1991 Moulding, Jr. et al.
5,061,222 A 10/1991 Suris
5,063,905 A 11/1991 Farrell
5,070,995 A 12/1991 Schaffer et al.
5,097,816 A 3/1992 Miller
5,097,985 A 3/1992 Jones
5,166,457 A 11/1992 Lorenzetti
5,233,125 A 8/1993 Bouver et al.
5,251,906 A 10/1993 Heller et al.
5,282,454 A 2/1994 Bell et al.
5,322,283 A 6/1994 Ritchie et al.
5,335,579 A 8/1994 David
5,337,726 A 8/1994 Wood
5,353,712 A 10/1994 Olson
5,361,746 A 11/1994 Szente
5,383,442 A 1/1995 Tippmann
5,456,153 A 10/1995 Bentley et al.
5,464,208 A 11/1995 Pierce
5,490,493 A 2/1996 Salansky
5,497,758 A 3/1996 Dobbins et al.
5,505,188 A 4/1996 Williams
5,507,271 A 4/1996 Actor
5,511,333 A 4/1996 Farrell
5,520,171 A 5/1996 David
5,542,570 A 8/1996 Nottingham et al.
5,555,662 A 9/1996 Teetzel
5,561,258 A 10/1996 Bentley et al.
5,600,083 A 2/1997 Bentley et al.
5,673,812 A 10/1997 Nelson
5,675,110 A 10/1997 Gyre et al.
5,722,383 A 3/1998 Tippmann, Sr. et al.
5,727,538 A 3/1998 Ellis
5,736,720 A 4/1998 Bell et al.
5,749,797 A 5/1998 Sunseri et al.
5,755,056 A 5/1998 Danner
5,771,875 A 6/1998 Sullivan
5,784,985 A 7/1998 Lodico et al.
5,791,325 A 8/1998 Anderson
5,794,606 A 8/1998 Deak
5,809,983 A 9/1998 Stoneking
5,816,232 A 10/1998 Bell

(56) References Cited

U.S. PATENT DOCUMENTS 5,819,715 A 10/1998 Haneda et al.
5,836,583 A 11/1998 Towers
5,839,422 A 11/1998 Ferris
5,881,962 A 3/1999 Schmidt et al.
5,887,578 A 3/1999 Backeris et al.
5,913,399 A 6/1999 Takemoto et al.
5,947,100 A 9/1999 Anderson
5,954,042 A 9/1999 Harvey
6,032,395 A 3/2000 Bentley et al.
6,055,975 A 5/2000 Gallagher et al.
6,062,208 A 5/2000 Seefeldt et al.
6,083,105 A 7/2000 Ronin et al.
6,085,735 A 7/2000 Cheek, Jr.
6,109,252 A 8/2000 Stevens
6,206,562 B1 3/2001 Eyraud et al.
6,213,110 B1 4/2001 Christopher et al.
6,220,237 B1 4/2001 Johnson et al.
6,305,367 B1 10/2001 Kotsiopoulos et al.
6,311,682 B1 11/2001 Rice et al.
6,325,233 B1 12/2001 Harris
6,327,953 B1 12/2001 Andresen
6,347,621 B1 2/2002 Guthrie
6,349,711 B1 2/2002 Perry
6,374,819 B1 4/2002 Ming-Hsien
6,408,836 B1 6/2002 Ming Hsien
6,408,837 B1 6/2002 Johnson et al.
D459,767 S 7/2002 Rushton
6,415,781 B1 7/2002 Perrone
6,418,919 B1 7/2002 Perrone
6,425,781 B1 7/2002 Bernstein et al.
6,460,530 B1 10/2002 Backeris et al.
6,467,473 B1 10/2002 Kotsiopoulos
6,468,879 B1 10/2002 Lamure et al.
6,481,432 B2 11/2002 Rushton et al.
6,488,019 B2 12/2002 Kotsiopoulos
6,502,567 B1 1/2003 Christopher et al.
6,520,854 B1 2/2003 McNally
6,526,955 B1 3/2003 Juan
6,588,412 B2 7/2003 Ferrara et al.
6,591,824 B2 7/2003 Hatcher
6,601,780 B1 8/2003 Sheng
6,609,511 B2 8/2003 Kotsiopoulos et al.
6,615,814 B1 9/2003 Rice et al.
6,644,293 B2 11/2003 Jong
6,644,295 B2 11/2003 Jones
6,644,296 B2 11/2003 Gardner, Jr.
6,666,203 B2 12/2003 Maeda et al.
6,684,873 B1 2/2004 Anderson et al.
6,701,907 B2 3/2004 Christopher et al.
6,701,909 B2 3/2004 Tiberius et al.
6,708,685 B2 3/2004 Masse
6,722,355 B1 4/2004 Andrews, Jr.
6,725,852 B1 4/2004 Yokota et al.
6,729,321 B2 5/2004 Ho
6,729,497 B2 5/2004 Rice et al.
6,739,322 B2 5/2004 Rice et al.
6,739,323 B2 5/2004 Tippmann, Jr.
6,742,512 B1 6/2004 Ho et al.
6,752,137 B2 6/2004 Brunette et al.
6,792,933 B2 9/2004 Christopher et al.
6,802,306 B1 10/2004 Rice
6,860,258 B2 3/2005 Farrell
6,889,680 B2 5/2005 Christopher et al.
6,899,328 B2 5/2005 Halliburton et al.
6,915,792 B1 7/2005 Sheng
6,925,997 B2 8/2005 Sheng
6,978,776 B2 12/2005 Hamilton
6,981,493 B1 1/2006 Poteracke
7,000,603 B1 2/2006 Steenbeke
7,017,569 B2 3/2006 Jong
7,021,302 B2 4/2006 Neumaster et al.
7,040,505 B2 5/2006 Hashimoto et al.
7,077,118 B2 7/2006 Lewis
D535,339 S 1/2007 Broersma
7,159,585 B2 1/2007 Quinn et al.
7,210,473 B2 5/2007 Jong
7,216,641 B2 5/2007 Friesen et al.
7,222,617 B2 5/2007 Andresen
D544,047 S 6/2007 Bell et al.
7,231,914 B2 6/2007 Hatcher
7,234,456 B2 6/2007 Andresen
7,270,120 B2 9/2007 Broersma et al.
7,270,121 B2 9/2007 Lubben
7,322,347 B2 1/2008 Broersma
7,322,348 B2 1/2008 Chen
7,343,909 B2 3/2008 Christopher et al.
D567,302 S 4/2008 Choi
D567,303 S 4/2008 Neumaster
7,357,129 B2 4/2008 Neumaster et al.
7,357,130 B2 4/2008 Broersma
D572,318 S 7/2008 Broersma
7,428,899 B2 9/2008 Andersen
7,441,556 B2 10/2008 Friesen et al.
7,445,002 B2 11/2008 Christopher et al.
7,458,370 B2 12/2008 Chen
D584,776 S 1/2009 Stevens
7,487,769 B2 2/2009 Lubben
7,490,597 B2 2/2009 Hatcher
7,527,049 B2 5/2009 Sheng
7,568,478 B2 8/2009 Hedberg
7,591,260 B1 9/2009 Mu
D602,537 S 10/2009 Stevens
D604,371 S 11/2009 Stevens
7,617,817 B1 11/2009 Kulp
7,624,726 B2 12/2009 Wood
7,654,255 B2 2/2010 Spicer
7,673,627 B2 3/2010 Higgins et al.
7,694,669 B2 4/2010 Campo
7,699,047 B2 4/2010 Tippman, Jr. et al.
7,762,246 B2 7/2010 Telford
7,770,569 B2 8/2010 Andresen
7,770,571 B2 8/2010 Tippmann, Jr. et al.
7,779,825 B2 8/2010 Estrate
7,832,389 B2 11/2010 Christopher
7,841,328 B2 11/2010 Italia et al.
7,854,220 B1 12/2010 Neumaster
7,913,679 B2 3/2011 Quinn et al.
7,921,834 B2 4/2011 Hamilton
7,921,835 B2 4/2011 Campo et al.
7,966,999 B2 6/2011 Bosch et al.
8,006,425 B2 8/2011 Burt et al.
6,213,110 C1 11/2011 Christopher et al.
8,047,191 B2 11/2011 Christopher et al.
8,061,342 B2 11/2011 Christopher et al.
8,091,541 B2 1/2012 Andresen
8,100,119 B2 1/2012 Hall
8,104,462 B2 1/2012 Christopher et al.
8,210,159 B1 7/2012 Neumaster et al.
8,235,030 B2 8/2012 Kaakkola et al.
8,235,031 B2 8/2012 Kim
8,251,050 B2 8/2012 Christopher et al.
RE43,756 E 10/2012 Christopher et al.
8,333,181 B1 12/2012 Rice
8,356,589 B2 1/2013 Karnis
8,375,929 B2 2/2013 Andresen
8,381,710 B2 2/2013 Nguyen
8,387,607 B2 3/2013 Christopher et al.
8,448,631 B2 5/2013 Spicer et al.
8,561,600 B2 10/2013 Christopher et al.
8,746,225 B2 6/2014 Christopher et al.
8,950,387 B2 2/2015 Stevens et al.
9,127,902 B2 9/2015 Macy
9,212,864 B2 12/2015 Christopher et al.
2001/0029937 A1 10/2001 Hatcher
2001/0039945 A1 11/2001 Rushton et al.
2002/0014230 A1 2/2002 Christopher et al.
2002/0020402 A1 2/2002 Kotsiopoulos
2002/0059927 A1 5/2002 Woods, Sr.
2002/0059928 A1 5/2002 Ferrara et al.
2002/0092513 A1 7/2002 Christopher et al.
2002/0112713 A1 8/2002 Backeris et al.
2002/0117159 A1 8/2002 Kotsiopoulos et al.
2002/0170552 A1 11/2002 Gardner, Jr.
2002/0175465 A1 11/2002 Halliburton et al.

(56) References Cited

U.S. PATENT DOCUMENTS

| | | | | |
|---|---|---|---|---|
| 2003/0005918 | A1 | 1/2003 | Jones | |
| 2003/0010330 | A1 | 1/2003 | Jong | |
| 2003/0024520 | A1 | 2/2003 | Dobbins | |
| 2003/0047173 | A1 | 3/2003 | Juan | |
| 2003/0047174 | A1 | 3/2003 | Tiberius et al. | |
| 2003/0079731 | A1 | 5/2003 | Dobbins | |
| 2003/0121927 | A1 | 7/2003 | Rice et al. | |
| 2003/0127084 | A1 | 7/2003 | Tippmann, Jr. | |
| 2003/0127085 | A1 | 7/2003 | Brunette et al. | |
| 2003/0131835 | A1 | 7/2003 | Rice et al. | |
| 2003/0168052 | A1 | 9/2003 | Masse | |
| 2003/0168053 | A1 | 9/2003 | Farrell | |
| 2003/0188730 | A1 | 10/2003 | Maeda et al. | |
| 2004/0000300 | A1 | 1/2004 | Ho | |
| 2004/0074487 | A1 | 4/2004 | Christopher et al. | |
| 2004/0074489 | A1 | 4/2004 | Neumaster et al. | |
| 2004/0112356 | A1 | 6/2004 | Hatcher | |
| 2004/0134475 | A1 | 7/2004 | Jong | |
| 2004/0194772 | A1 | 10/2004 | Hamilton | |
| 2004/0211402 | A1 | 10/2004 | Christopher et al. | |
| 2004/0216728 | A1 | 11/2004 | Jong | |
| 2004/0245276 | A1 | 12/2004 | Hashimoto et al. | |
| 2005/0028801 | A1 | 2/2005 | Lewis | |
| 2005/0121015 | A1 | 6/2005 | Postorivo, Jr. | |
| 2005/0166904 | A1 | 8/2005 | Friesen et al. | |
| 2005/0188973 | A1* | 9/2005 | Monks | F41B 11/50 124/42 |
| 2005/0188974 | A1 | 9/2005 | Pedicini et al. | |
| 2005/0188978 | A1 | 9/2005 | Tiberius et al. | |
| 2005/0217653 | A1 | 10/2005 | Christopher et al. | |
| 2005/0241628 | A1 | 11/2005 | Hatcher | |
| 2005/0274370 | A1 | 12/2005 | Lubben | |
| 2005/0274371 | A1 | 12/2005 | Lubben | |
| 2005/0284456 | A1 | 12/2005 | Chipley | |
| 2005/0284457 | A1 | 12/2005 | Hatcher | |
| 2006/0005822 | A1 | 1/2006 | Quinn et al. | |
| 2006/0005823 | A1 | 1/2006 | Quinn et al. | |
| 2006/0032488 | A1 | 2/2006 | Telford | |
| 2006/0037597 | A1 | 2/2006 | Wood | |
| 2006/0042614 | A1 | 3/2006 | Broersma | |
| 2006/0054151 | A1 | 3/2006 | Christopher et al. | |
| 2006/0081233 | A1 | 4/2006 | Andresen | |
| 2006/0081234 | A1 | 4/2006 | Andresen | |
| 2006/0086347 | A1 | 4/2006 | Hedberg | |
| 2006/0124118 | A1 | 6/2006 | Dobbins | |
| 2006/0130821 | A1 | 6/2006 | Hamilton | |
| 2006/0157040 | A1 | 7/2006 | Broersma et al. | |
| 2006/0157041 | A1 | 7/2006 | Friesen | |
| 2006/0196489 | A1 | 9/2006 | Campo | |
| 2006/0249131 | A1 | 11/2006 | Broersma | |
| 2006/0254572 | A1 | 11/2006 | Hall | |
| 2007/0012303 | A1 | 1/2007 | Christopher et al. | |
| 2007/0012304 | A1 | 1/2007 | van Dorsser et al. | |
| 2007/0017494 | A1 | 1/2007 | Andresen | |
| 2007/0017495 | A1 | 1/2007 | Andresen | |
| 2007/0023025 | A1 | 2/2007 | Neumaster et al. | |
| 2007/0056573 | A1 | 3/2007 | Campo | |
| 2007/0062506 | A1 | 3/2007 | Bell | |
| 2007/0101981 | A1 | 5/2007 | Chen | |
| 2007/0113834 | A1 | 5/2007 | Spicer | |
| 2007/0137631 | A1 | 6/2007 | Christopher | |
| 2007/0175463 | A1 | 8/2007 | Higgins et al. | |
| 2007/0181117 | A1 | 8/2007 | Tippmann, Jr. et al. | |
| 2007/0215137 | A1 | 9/2007 | Jones et al. | |
| 2007/0246479 | A1 | 10/2007 | Andresen | |
| 2007/0256676 | A1 | 11/2007 | Orvis et al. | |
| 2008/0017178 | A1 | 1/2008 | Marques et al. | |
| 2008/0047535 | A1 | 2/2008 | Handel | |
| 2008/0047536 | A1 | 2/2008 | Chen | |
| 2008/0047537 | A1 | 2/2008 | Kulp et al. | |
| 2008/0053422 | A1 | 3/2008 | Estrate | |
| 2008/0087264 | A1 | 4/2008 | Postorivo | |
| 2008/0141990 | A1 | 6/2008 | Andresen | |
| 2008/0178859 | A1 | 7/2008 | Moore et al. | |
| 2008/0216805 | A1 | 9/2008 | Christopher et al. | |
| 2008/0236558 | A1* | 10/2008 | Bosch | F41B 11/53 124/48 |
| 2008/0257327 | A1* | 10/2008 | Monks | F41B 11/50 124/48 |
| 2008/0295818 | A1 | 12/2008 | Styles et al. | |
| 2009/0000608 | A1 | 1/2009 | Christopher et al. | |
| 2009/0025700 | A1 | 1/2009 | Andersen | |
| 2009/0056691 | A1 | 3/2009 | Christopher et al. | |
| 2009/0133680 | A1 | 5/2009 | Christopher et al. | |
| 2009/0173330 | A1 | 7/2009 | Akins | |
| 2009/0178659 | A1 | 7/2009 | Spicer | |
| 2009/0194088 | A1 | 8/2009 | Tippmann, Jr. et al. | |
| 2009/0241929 | A1 | 10/2009 | Italia et al. | |
| 2010/0126485 | A1* | 5/2010 | Neumaster | F41B 11/57 124/51.1 |
| 2010/0258101 | A1 | 10/2010 | Campo et al. | |
| 2011/0067681 | A1 | 3/2011 | Stevens et al. | |
| 2011/0083654 | A1* | 4/2011 | Galinson | F41A 9/36 124/59 |
| 2011/0186025 | A1 | 8/2011 | Spicer et al. | |
| 2011/0220086 | A1 | 9/2011 | Bosch et al. | |
| 2012/0042862 | A1 | 2/2012 | Christopher et al. | |
| 2012/0125303 | A1 | 5/2012 | Christopher et al. | |
| 2012/0227722 | A1* | 9/2012 | Bell | F41B 11/57 124/51.1 |
| 2012/0272940 | A1 | 11/2012 | Christopher et al. | |
| 2014/0209082 | A1 | 7/2014 | Stevens | |

FOREIGN PATENT DOCUMENTS

| | | |
|---|---|---|
| DE | 2035097 | 1/1972 |
| DE | 3721527 | 1/1989 |
| DE | 4343870 | 6/1994 |
| DE | 4343871 | 6/1995 |
| DE | 19922589 | 12/2000 |
| EP | 0075970 | 4/1983 |
| EP | 1054228 | 11/2000 |
| EP | 1653189 | 5/2006 |
| FR | 921527 | 5/1947 |
| GB | 470201 | 8/1937 |
| GB | 551077 | 2/1943 |
| GB | 2056635 | 3/1981 |
| GB | 2322438 | 8/1998 |
| JP | 1179898 | 7/1989 |
| JP | 6-325233 | 11/1994 |
| TW | M255391 | 1/2005 |
| WO | 98/13660 | 4/1998 |
| WO | 01/44745 | 6/2001 |
| WO | 02/42708 | 5/2002 |
| WO | 03/087698 | 10/2003 |
| WO | 07/033309 | 3/2007 |
| WO | 07/035601 | 3/2007 |
| WO | 07/044546 | 4/2007 |
| WO | 07/044822 | 4/2007 |
| WO | 07/098554 | 9/2007 |
| WO | 08/104061 | 4/2008 |
| WO | 09/009748 | 1/2009 |
| WO | 09/015393 | 1/2009 |

OTHER PUBLICATIONS

WARPIG—World And Regional Paintball Information Guide, http://www.warpig.com/paintball/technical/loaders/halo/review.shtml, warpig.com, Odyssey Halo By Bill Mills, Dec. 2001, pp. 1 to 7.

Odyssey Halo B Paintball Hopper Review, http://www.paintball-gun-review.com/hopper-reviews/odyssey-halo-b..., Paintball Gun Review, Odyssey Halo B Paintball Hopper Review, 2004 Paintball-Gun-Review.com, pp. 1 to 3.

www.ODYSSEYPAINTBALL.com, http://web.archive.org/web/20030205112543/http://www.odysseypain..., Odyssey Paintball Products, Understanding Halo B, pp. 1 to 3.

WARPIG—World And Regional Paintball Information Guide, http://www.warpig.com/paintball/technical/loaders/evlution...

eVLution 2 Sneak Preview, by Bill Mills, Aug. 2001, pp. 1 to 4.

(56) References Cited

OTHER PUBLICATIONS

WARPIG—World And Regional Paintball Information Guide, http://www.warpig.com/paintball/technical/loaders/evlution/index.shtml Brass Eagle's eVLution Loader, by Bill Mills, Aug. 2000, pp. 1 to 7.
WARPIG—World And Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 4.
WARPIG—World and Regional Paintball Information Guide, http://www.warpig.com/paintball/technical/loaders/lineup WARPIG Ballistic Labs Loader Speed Comparison, by Bill Mills, Sep. 2001, 8 pages.
FT-12 Owner's Manual, Ver. 05/12, Manufactured by Tiggmann (24 pages).
U.S. Appl. No. 13/657,749, filed Oct. 22, 2012 Office Action dated Dec. 12, 2012
U.S. Appl. No. 13/657,749, filed Oct. 22, 2012 Reply filed Jun. 12, 2013.
U.S. Appl. No. 13/657,749, filed Oct. 22, 2012 Final Office Action dated Sep. 5, 2013.
U.S. Appl. No. 13/657,749, filed Oct. 22, 2012 RCE, Reply, and Terminal Disclaimer filed Mar. 5, 2014.
U.S. Appl. No. 13/657,749, filed Oct. 22, 2012 Terminal Disclaimer Approved on Mar. 26, 2014.
U.S. Appl. No. 13/657,749, filed Oct. 22, 2012 Office Action dated Apr. 7, 2014.
U.S. Appl. No. 13/657,749, filed Oct. 22, 2012 Reply filed Sep. 8, 2014.
U.S. Appl. No. 13/657,749, filed Oct. 22, 2012 Final Office Action dated Jan. 2, 2015.
U.S. Appl. No. 13/657,749, filed Oct. 22, 2012 Reply to Final filed May 4, 2015.
U.S. Appl. No. 13/657,749, filed Oct. 22, 2012 Advisory Action dated May 26, 2015.

* cited by examiner

PAINTBALL LOADER

CROSS REFERENCE TO RELATED APPLICATIONS

This application is a continuation of U.S. patent application Ser. No. 14/968,499, filed Dec. 14, 2015, which is a continuation of U.S. patent application Ser. No. 14/058,589, filed Oct. 21, 2013, now U.S. Pat. No. 9,212,864, issued Dec. 15, 2015, which is a continuation of U.S. patent application Ser. No. 13/301,265, filed Nov. 21, 2011, now U.S. Pat. No. 8,561,600, issued Oct. 22, 2013, which is a continuation of U.S. patent application Ser. No. 12/040,119, filed Feb. 29, 2008, now U.S. Pat. No. 8,061,342, issued Nov. 22, 2011, which is a continuation of U.S. patent application Ser. No. 11/522,708, filed Sep. 18, 2006, now abandoned, which is a continuation U.S. patent application Ser. No. 10/851,837, filed May 21, 2004, now abandoned, which is a continuation of U.S. patent application Ser. No. 09/949,440, filed Sep. 7, 2001, now U.S. Pat. No. 6,792,933, issued Sep. 21, 2004, which is a continuation-in-part of a U.S. patent application Ser. No. 09/689,573, filed Oct. 12, 2000, now U.S. Pat. No. 6,502,567, issued Jan. 7, 2003, which is a continuation-in-part of U.S. patent application Ser. No. 09/465,440, filed Dec. 16, 1999, now U.S. Pat. No. 6,213,110, issued Apr. 10, 2001, all of which are incorporated by reference in their entireties as if fully set forth herein.

FIELD OF INVENTION

This invention relates to paintball loaders, and more particularly, to a paintball loader for feeding paintballs into a paintball gun.

BACKGROUND

A popular war game has developed over the years, which uses paintball guns. Players use the paintball guns to shoot paintballs. These paintballs are gelatin-covered spherical capsules filled with paint. During play of the game, the players on each team advance towards each other. A player is eliminated from the game when the player is hit by a paintball fired from an opposing player's gun. When the paintball hits a player, a "splat" of paint is left on the player.

Typically, an existing paintball loader includes a housing which is placed on an upper portion of a paintball gun. The housing is shaped to hold a large quantity of paintballs. At the bottom of the housing is an outlet tube through which the paintballs drop by the force of gravity. The outlet tube leads to an inlet tube located on the upper portion of the gun.

During the operation of existing paintball loaders, paintballs sequentially drop by gravity through the outlet tube into the inlet tube of the gun. The inlet tube directs each paintball into the firing chamber of the gun, where the paintball is propelled outwardly from the gun by compressed air.

Co-pending U.S. patent application Ser. No. 09/689,573 ('573), now U.S. Pat. No. 6,502,567, describes a paintball feed system providing enhanced performance over existing paintball feed systems. Additionally, '573 discloses a paintball loader which reliably and forcibly delivers paintballs to a paintball gun at a rapid, selectable rate, while actively preventing paintball jams. However, paintball jams may still occur in the loader disclosed in '573. Specifically, the disclosed paintball loader utilizes a plurality of fins spaced at such a distance as to create gaps to accommodate a single paintball. Due to the close proximity of the fins, there is a tendency for the paintballs to partially fall into a gap, which can result in a paintball jam. In addition, if a paintball breaks within the paintball loader, because of the large amount of fins and the small area of the gaps, cleaning the paintball loader can be difficult. Since existing paintball loaders utilize several fins, space for which paintballs could be accommodated is lost to allow space for the fins. Thus, the paintball feed rate is reduced for each rotation of the cone because of this lost space.

It would be a distinct advantage to have a drive cone which feeds the paintballs at a faster rate, while preventing jams of partially fallen paintballs into the gaps located between the fins. It is an object of the present invention to provide such an apparatus.

SUMMARY

In one aspect, the present invention is a rapid feed paintball loader for use on a paintball gun. The paintball loader includes a container for holding a plurality of paintballs and a drive cone rotatably mounted on a bottom portion of the container. At least one fin is affixed to a top feed surface of the drive cone. The fin divides or separates the top feed surface into at least a gap or section which is preferably large enough to accommodate more than one paintball. The loader also includes a motor that rotates the drive cone. In addition, an exit tube exits from the bottom portion of the container and leads to an inlet tube of the paintball gun. The motor actuates upon demand.

In another aspect, the present invention is a drive cone for use on a paintball loader of a paintball gun having a container for holding a plurality of paintballs and an exit tube located on the container leading to the paintball gun. The drive cone includes a drive cone rotatably mounted on a bottom portion of the container and at least one fin affixed to a top feed surface of the drive cone. The fin divides or separates the top feed surface of the drive cone into at least one gap which is preferably large enough to accommodate more than one paintball. The drive cone receives paintballs from the container and drives the paintballs from the gap into the exit tube.

In still another aspect, the present invention is a rapid feed paintball loader for use on a paintball gun. The paintball loader includes a container for holding a plurality of paintballs and at least one fin located at a bottom portion of the container. The fin divides or separates the top feed surface into at least one gap that is preferably large enough to accommodate at least one paintball. The fin rotates on an axis running perpendicularly through the bottom portion of the container. The paintball loader also includes an exit tube exiting from the bottom portion of the container and leads to an inlet tube of the paintball gun. The exit tube has a sloped exit portion. In addition, a tube extension is mounted on an interior surface of the container adjacent to the sloped exit portion of the exit tube. The tube extension is mounted at a height which is above the top feed surface of the fin and has a radius of curvature that is approximately equal to the radius of a paintball. The paintball loader also may include a deflector for deflecting paintballs downward into the gap or upward to pass over the tube extension. The deflector is pivotably mounted on the interior surface of the container adjacent to the tube extension. The deflector is mounted at a height which is above the top feed surface of the fin and which is below a bottom portion of the tube extension. A motor rotates the drive cone upon demand.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF THE PREFERRED EMBODIMENTS

Figure 1:
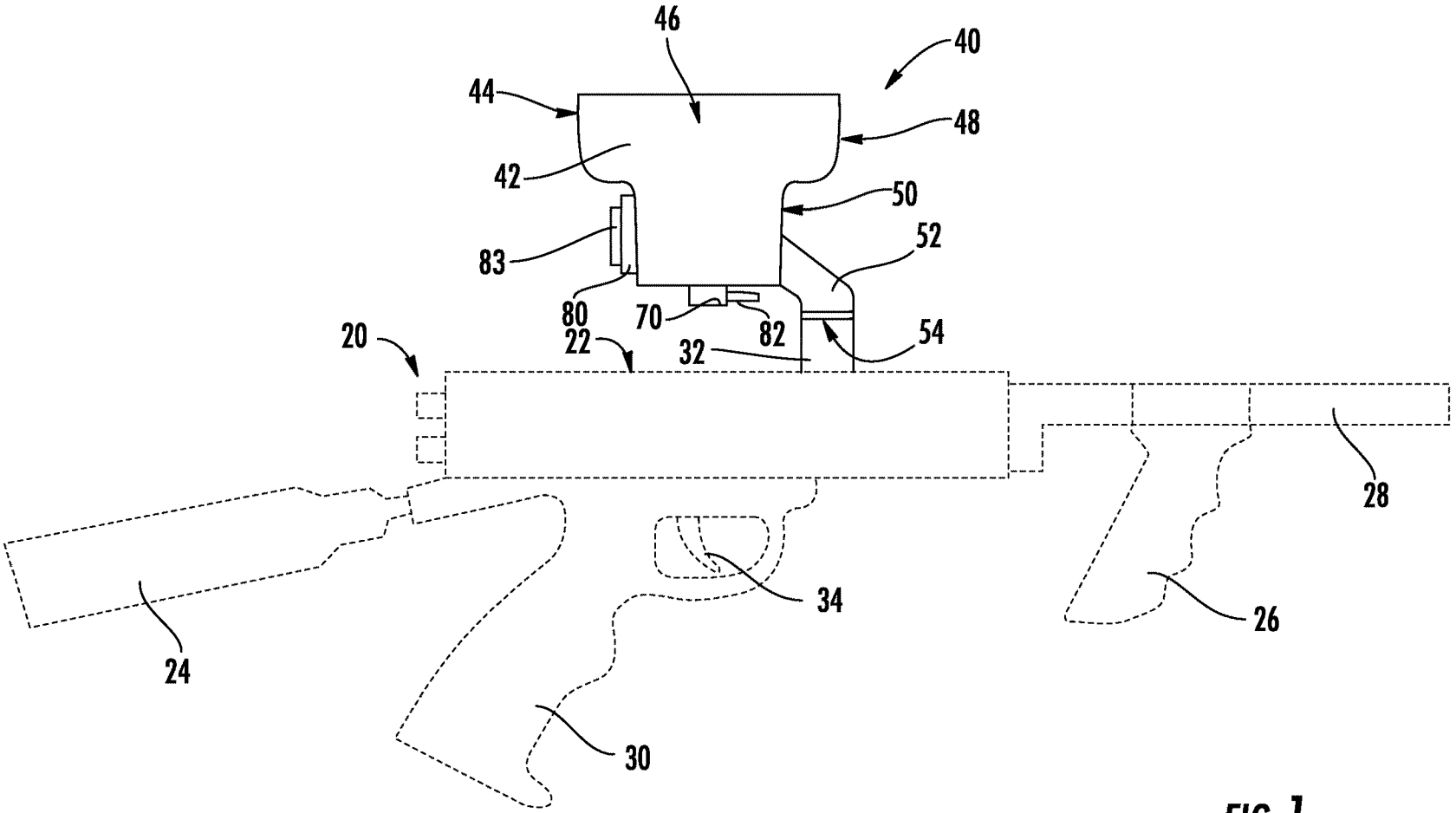
FIG. 1 is a side elevational view of a rapid feed paintball loader constructed in accordance with the teachings of the present invention and operatively attached to a representative paintball gun illustrated in phantom.

A drive cone for use in a paintball loader 40 for rapidly delivering paintballs while preventing paintball jams is disclosed. FIG. 1 is a side elevational view of a rapid feed paintball loader 40 constructed in accordance with the teachings of the present invention and operatively attached to a representative paintball gun 20 illustrated in phantom. The paintball gun 20 includes a main body 22, a compressed gas cylinder 24, a front handgrip 26, a barrel 28, and a rear handgrip 30. The paintball gun 20 also includes an inlet tube 32 leading to a firing chamber in the interior of the main body 22 and a trigger 34. The front handgrip 26 projects downwardly from the barrel 28 and provides an area for gripping by an operator of the paintball gun 20. The compressed gas cylinder 24 is typically secured to a rear portion of the paintball gun 20. The compressed gas cylinder 24 normally contains CO2, although any compressible gas may be used.

In operating the paintball gun 20, the trigger 34 is squeezed, thereby actuating the compressed gas cylinder 24 to release bursts of compressed gas. The bursts of gas are used to eject paintballs 68 outwardly through the barrel 28. The paintballs 68 are continually fed by the paintball loader 40 through the inlet tube 32 to the firing chamber. Although FIG. 1 depicts an automatic paintball gun 20, the paintball gun 20 may also be a semi-automatic gun.

The rapid feed paintball loader 40 includes a paintball container 42 having a container wall 44 forming an interior area 46. The container 42 is divided into an upper portion 48 and a lower portion 50. An exit tube 52 leads from the bottom portion of the container 42 to an outlet opening 54. The exit tube 52 is positioned on top of the inlet tube 32 of the paintball gun 20.

Figure 2:
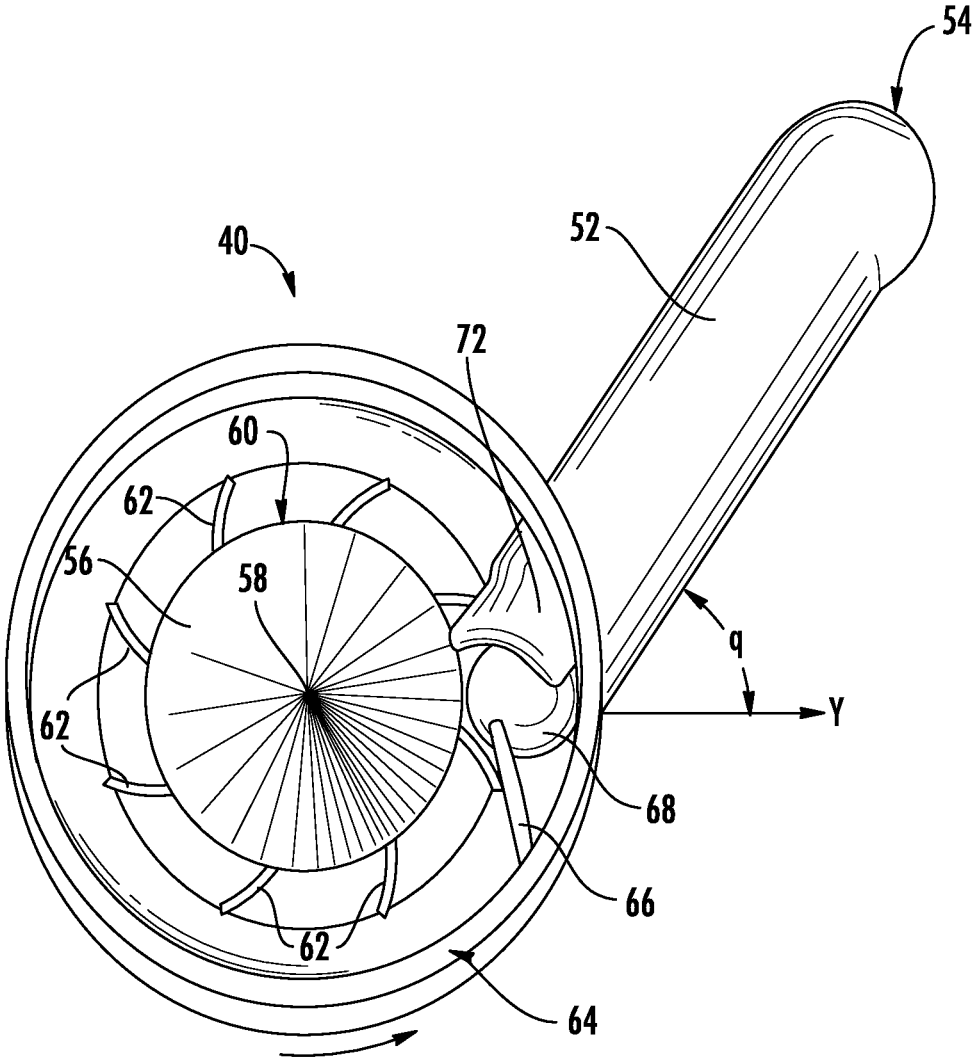
FIG. 2 PRIOR ART
FIG. 2 is a top view of a drive cone of a paintball loader.

FIG. 2 is a top view of the lower portion 50 of a rapid feed paintball loader 40 showing a drive cone 56 of a paintball loader 40. Mounted along a vertical center axis 58, located in the approximate center of the interior area 46, is the drive cone 56 having a conically-shaped interior surface area 60 with a plurality of fins 62 projecting upwardly from the top surface of the drive cone 56 and spiraling outwardly from an outer circumference of the interior area 46. The drive cone 56 is rotatably attached to a bottom portion of the paintball container 42, allowing rotation about the center axis 58. The exit tube 52 projects outwardly from a rim 64 of the lower portion 50 of the container wall 44 at an approximately 45 degree angle from the Y-axis. In addition, an upper part of the exit tube 52 extends towards the interior area 46 to form a paintball tube extension 72. A pivotable deflector 66 extends inwardly towards the vertical center axis from the rim 64. A paintball 68 is illustrated between two fins 62.

The drive cone 56 shown in FIG. 2 positions the plurality of fins 62 in such a fashion that only one paintball 68 may fit in between two fins 62. Since only one paintball may fit in each gap, there is an increased possibility that a paintball may only partially fall into the gap. By merely falling partially into the gap, the paintball may cause a jam. Additionally, since there are several fins 62 located on the drive cone 56, the space used for accommodating paintballs 68 is reduced by the number of fins 62. Also, when a paintball breaks within the paintball loader 40, since there are so many fins 62, and the gaps between the fins 62 are relatively small, cleaning the residue of the broken paintball may be very difficult.

Figure 3:
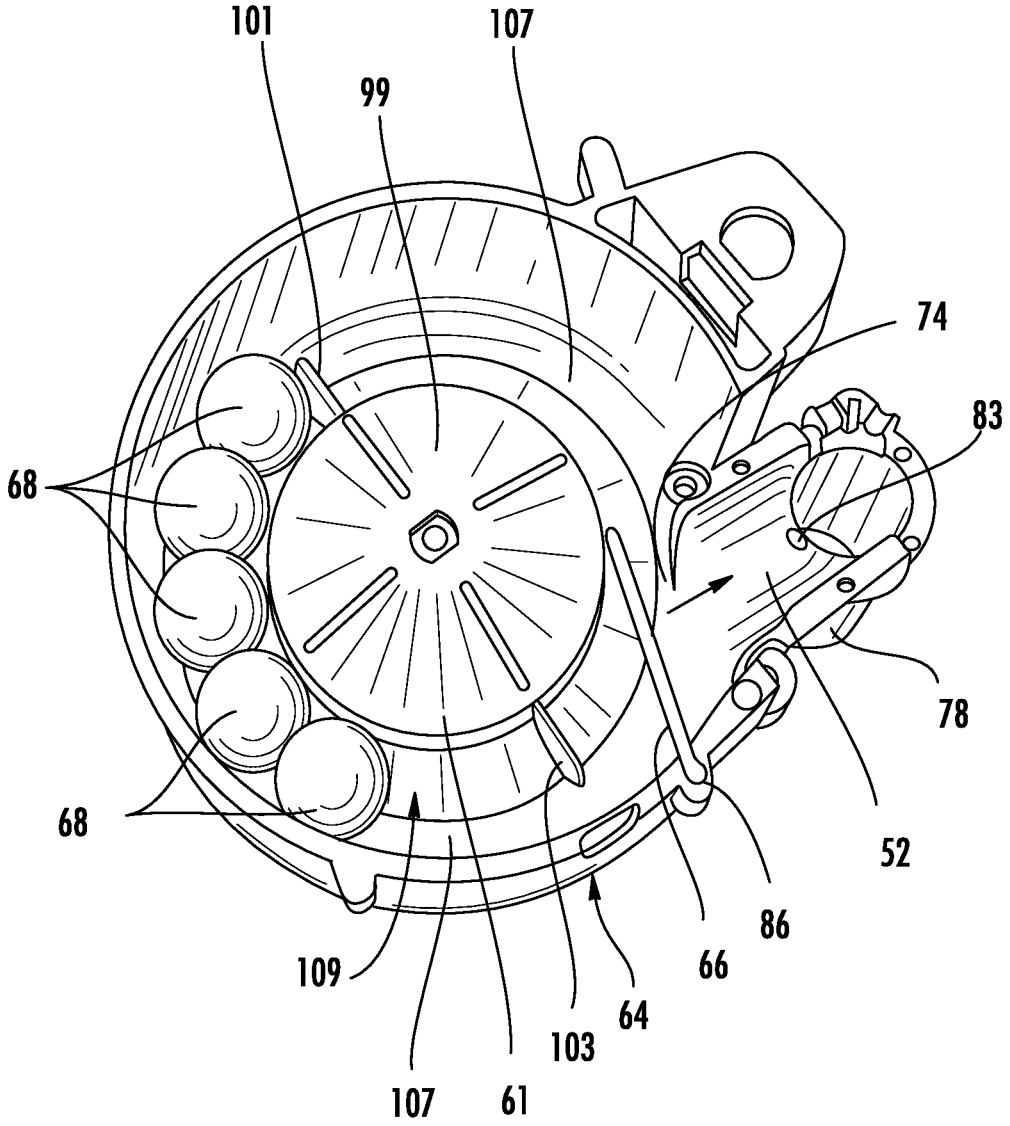
FIG. 3 is a top interior cutaway view of the paintball loader illustrating an improved cone, the exit tube, and a plurality of paintballs in the preferred embodiment of the present invention.

FIG. 3 is a top interior cutaway view of the paintball loader 40 illustrating an improved cone 99, the exit tube 52, and a plurality of paintballs 68 in the preferred embodiment of the present invention. The container wall 44 is curved and extends upwards to form the upper portion 48 (not shown in FIG. 3). The interior area 46, formed by the container wall 44, stores a plurality of paintballs 68 prior to being used by the paintball gun 20. Although a circular shape is illustrated in the top view of FIG. 3, the container 42 may be any size and shape which permits the paintballs 68 to drop towards the drive cone 99.

Figure 4:
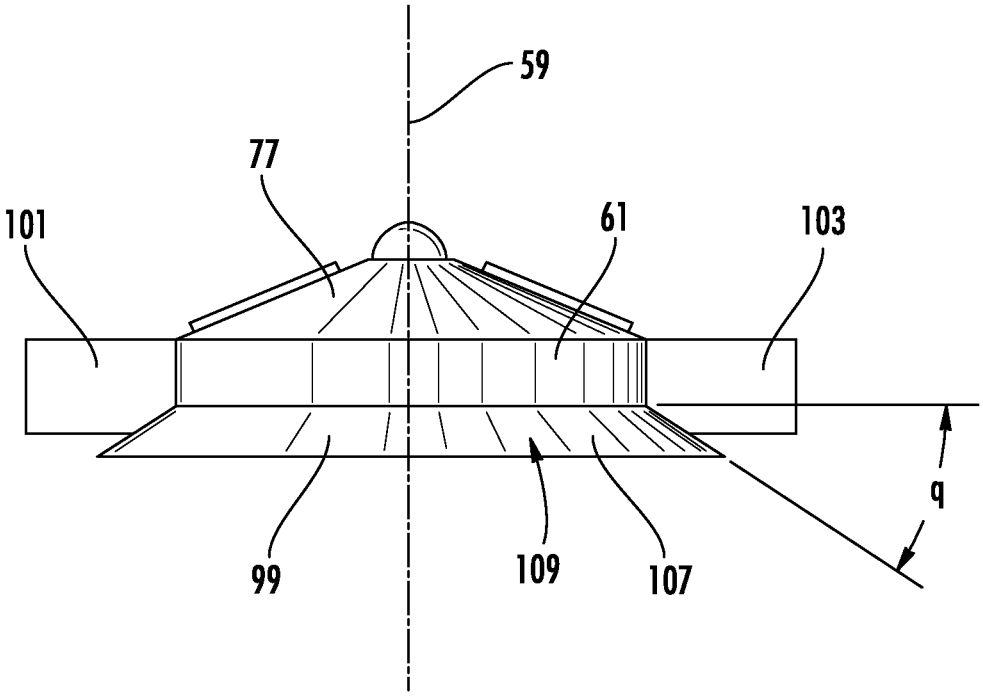
FIG. 4 is a side view of the drive cone of FIG. 3 separated from the paintball loader in the preferred embodiment of the present invention.
Figure 5:
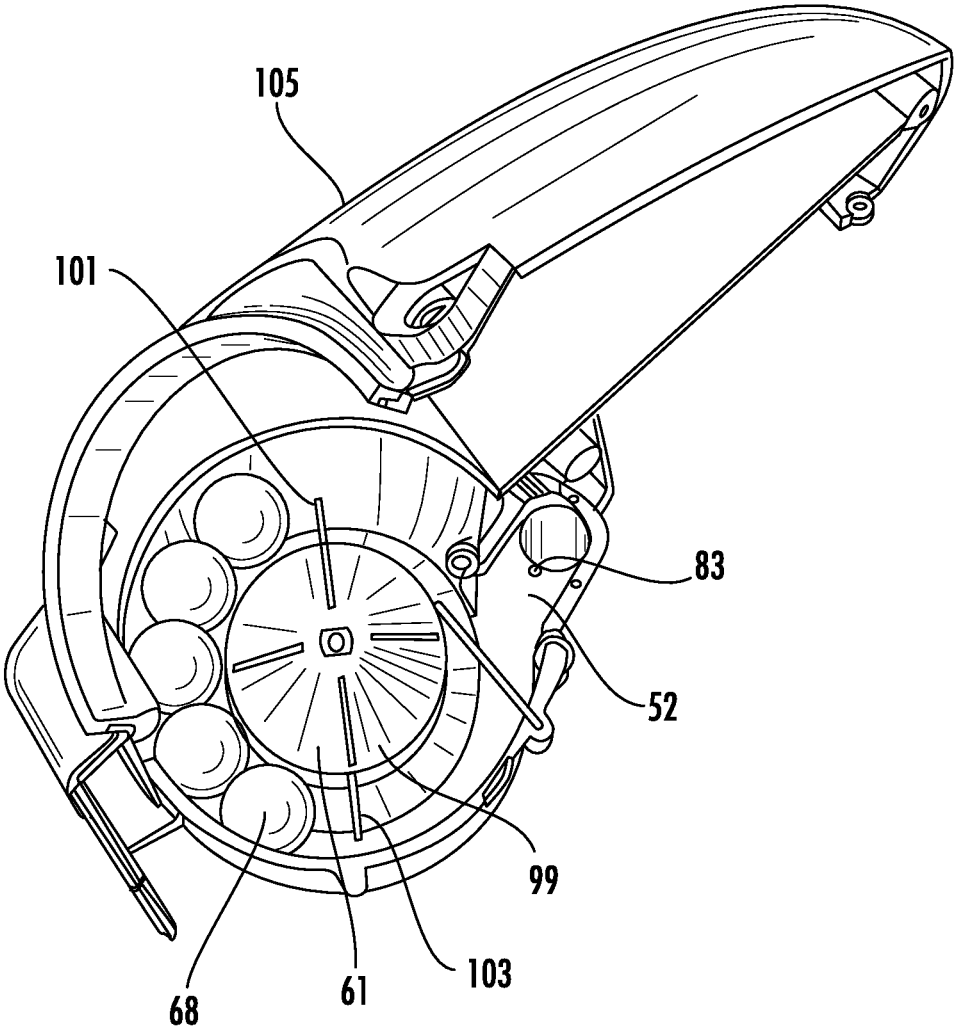
FIG. 5 is a top interior cutaway view of the paintball loader illustrating the improved drive cone, the exit tube, a plurality of paintballs, and an outer shell of the paintball loader in the preferred embodiment of the present invention.
Figure 6:
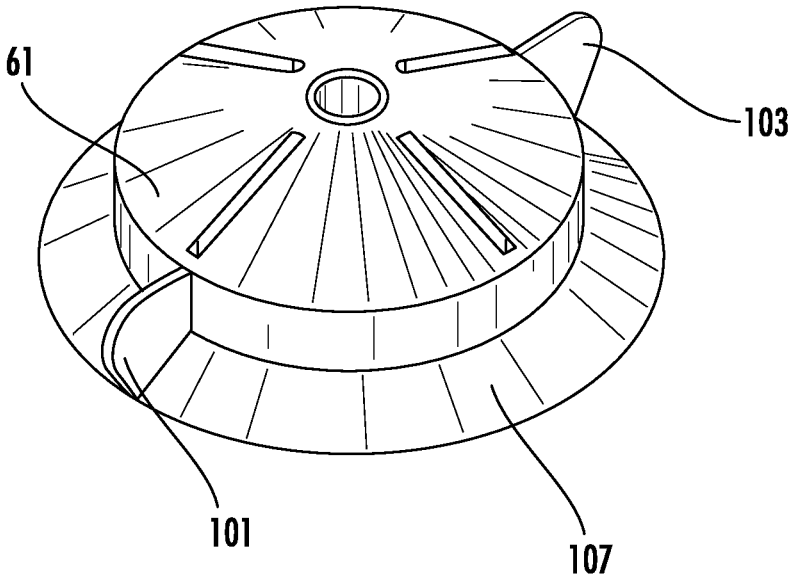
FIG. 6 illustrates a top perspective view of the drive cone of FIG. 4.

FIG. 4 is a side view of the drive cone 99 of FIG. 3 separated from the paintball loader 40 in the preferred embodiment of the present invention. In the preferred embodiment of the present invention, the drive cone 99 includes two fins 101 and 103. FIG. 5 is a top interior cutaway view of the paintball loader 40 illustrating the improved drive cone 99, the exit tube 52, a plurality of paintballs 68, and an outer shell 105 of the paintball loader 40 in the preferred embodiment of the present invention. FIG. 6 illustrates a top perspective view of the drive cone 99 of FIG. 4.

Referring to FIGS. 3-6, the drive cone 99 includes a conically-shaped interior area 61. The two fins originate at an outer circumference of the interior area 61 and project outwardly towards the rim 64 of the container wall 44. Between each fin is an enlarged gap 107 which may accommodate a plurality of paintballs 68 (as illustrated, five paintballs 68 may be positioned between each gap 107). However, the drive cone 99 may be sized to accommodate any amount of paintballs 68.

A feed surface 109 of the drive cone 99, which is the feed surface 109 between the fins 101 and 103 where the paintball 68 rests, is sloped downwardly at an angle of Φ (approximately 45 degrees in the preferred embodiment). The surface is preferably sloped at any angle which matches the slope of the exit tube 52 and allows paintballs 68 to feed into the exit tube 52. However, any slope angle may be utilized by the feed surface 109. The exit tube 52 is a circular tube with an inside diameter slightly larger than a conventional paintball. The exit tube 52 leads from an entry opening 74 to the outlet opening 54 which engages with the inlet tube 32 of the paintball gun 20. The exit tube 52 includes a sloped exit portion 76 and a vertical outlet portion 78. In the preferred embodiment of the present invention, the sloped exit portion of the exit tube 52 is sloped downwardly at an angle of approximately Φ which is the same slope as the top feed surface 109 of the drive cone 99. The pivotable deflector 66 is positioned above the top portion of the fins 101 and 103 and below the tube extension 72.

A tube extension 72 (shown in FIG. 2) is preferably located at the entry opening 74. The tube extension 72 is an extension of the exit tube 52. The tube extension 72 extends towards a center axis 59, while maintaining a clearance above the fins 101 and 103. The paintball tube extension 72 is formed as a scoop which has an interior radius of curvature approximately equal to the curvature of a paintball. The top of the scoop is positioned so that it partially covers a paintball that is pushed into position by the fins 101, 103 at the entry opening 74 of the exit tube 52. In this manner, the sloped surface of the drive cone 99, the fins 101, 103, the angled orientation (approximately 45 degrees) of the exit tube 52, and the tube extension 72 all equate to forcibly drive the paintball into the exit tube 52.

The drive cone 99 is rotated around the center axis 59 by a drive motor 70 (shown in FIG. 1). Additionally, the pivotable deflector 66 may be installed within the loader 40. The pivotable deflector 66 is attached to the rim 64 at pivot point 86, allowing the deflector to rotatably move as indicated in FIG. 3.

Referring to FIGS. 1, and 3-6, the operation of the rapid feed paintball loader 40 having the improved drive cone 99 will now be explained. The rapid feed paintball loader 40 is positioned on the top of the paintball gun 20. The loader 40 is connected to the gun 20 by attaching the exit tube 52, at the outlet opening 54, to the inlet tube 32 with an attaching device such as a clamp (not shown).

When an operator of the paintball gun 20 wishes to shoot paintballs, the trigger 34 is squeezed, which actuates the compressed gas cylinder 24. The compressed gas cylinder 24 releases bursts of compressed gas which are used to eject paintballs 68 through the barrel 28. A plurality of paintballs 68 is stored in the paintball container 42 and pass down the exit tube 52 for use by the paintball gun 20 when demanded by the operator.

The plurality of paintballs 68 located in the container 42 rest on top of the drive cone 99. The bottom-most paintballs 68 drop into either of the two enlarged gaps 107. The drive cone 99 is rotated by the drive motor 70, forcing the paintballs 68 outward and downward from the center axis 59 and forward toward the tube extension. The pivotable deflector 66 helps prevent jams by causing paintballs 68 to either fall into one of the gaps between the fins 101, 103 or to rise above the tube extension. The paintball 68 is forced into the entry opening 74 of the exit tube 52 by the tube extension. In addition, since the drive cone 99 is downwardly sloped toward the exit tube 52, the paintball falls downwardly, with the assistance of gravity, and outwardly towards the rim 64.

After the paintball enters the entry opening, the next paintball located adjacent the first paintball within the gap 107 is sequentially grasped by the tube extension and driven into the entry opening 74 behind the first paintball. Additional paintballs 68 located in the container 42, are drawn downwardly and outwardly by gravity and fill the vacated gaps. Positioning the fins 101, 103 on the outer circumference of the interior dome-shaped area 77 prevents paintballs 68 from being lodged in the upper portions of the gaps.

Once the paintball 68 enters the entry opening 74, it passes through the sloped exit portion to a vertical outlet portion of the exit tube 52. As the paintball passes through the exit tube 52, the paintball may actuate an optional electro-mechanical motor actuator switch/sensor 83 (shown in FIG. 3). As shown in FIG. 3, the motor actuator switch 83 may be utilized to detect the paintball passing through the exit tube 52. When the paintball 68 enters the exit tube 52, the motor actuator detects the paintball in the exit tube 52 and shuts off the motor 70. Thus, when the exit tube 52 fills up with paintballs, the motor 70 is automatically turned off. Then as paintballs 68 vacate the exit tube 52, the motor actuator does not detect a paintball and engages the motor 70 and rotates the drive cone 99. In this way, the exit tube 52 is always kept full of paintballs, ready for use when demanded by the paintball gun 20.

Although an electro-mechanical switch has been described to detect the presence of paintballs 68 in the exit tube 52, it should be understood that other devices may also be utilized to detect the paintballs 68 (e.g., infrared sensors, contact pads, optical sensors, etc.) without departing from the scope of the present invention. In the preferred embodiment, a reflective infrared (IR) optical sensor 83 may be utilized.

The pivotable deflector 66 may optionally be used to provide an additional, active device to prevent the jamming of paintballs 68 within the paintball loader. In existing paintball loaders, a paintball may be lodged between the tube extension or entry opening 74 of the exit tube 52 and one of the fins 101, 103 or "agitators" driving the paintball towards the exit tube 52, causing the loader to jam and stopping the rotation of the drive cone 99. To prevent the paintball from lodging between the tube extension (or extension of the exit tube 52 in existing loaders) and a fin (or agitator in existing loaders), the pivotable deflector 66 forces the paintball to either fall into one of the gaps between the fins 101, 103 or to rise upwardly away from the tube extension. In addition, the deflector pivots away from the paintball, thus preventing the paintball from lodging between the fin and the deflector. The deflector, although depicted with the paintball loader 40 illustrated in FIGS. 1-5, may be utilized on any active feed paintball loader to prevent the inadvertent lodging of paintballs 68 between a fin (or other agitating device) and the entry of the exit tube 52.

The improved drive cone 99 provides many advantages over existing drive cones. First of all, by enlarging the gaps to allow the accommodation of more paintballs, more paintballs 68 are fed into the entry opening 74 for each rotation of the drive cone 99. By feeding the paintballs 68 at a greater rate per rotation of the drive cone 99, the drive cone 99 enables the paintball loader 40 to feed the paintball gun 20 at a faster rate than existing drive cones. In addition, in existing paintball drive cones, the gaps between the fins 101, 103 only allow the accommodation of a single paintball. This reduced area in existing drive cones results in an increased likelihood that the paintball may only partially fall into the smaller gap. When the paintball can only fall partially into the smaller gap of the existing drive cones, a jam results between the paintball and fin. With the improved drive cone 99, the paintball has a large area for which the paintball may fall into. This results in less partial drops of the paintballs 68 into the gaps, which decreases or eliminate any jams which may occur.

The improved drive also allows for easy cleanup of the interior of the paintball loader 40 when paintballs 68 break within the loader 40. In addition, the improved drive cone 99 allows for manual feeding of the paintball when the feed system of the paintball loader malfunctions. For example, when a motor 70 fails on the paintball loader 40, a paintball gun 20 operator need only shake the gun 20 to move the paintballs 68 into the gun 20.

Figure 7:
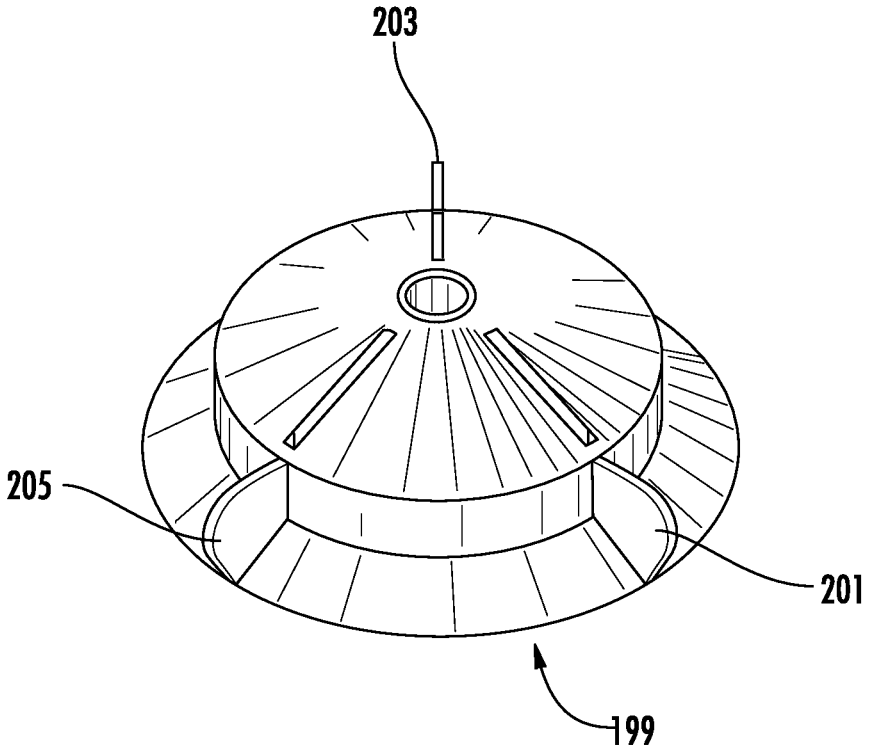
FIG. 7 illustrates a separate drive cone having three fins in a first alternate embodiment of the present invention.
Figure 8:
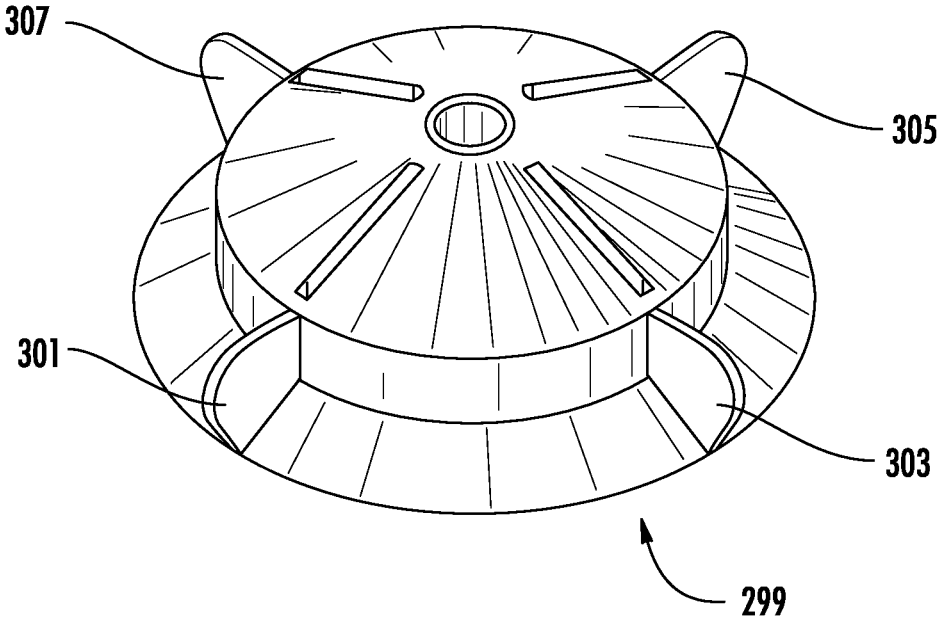
FIG. 8 illustrates a drive cone having four fins in a second alternate embodiment of the present invention.
Figure 9:
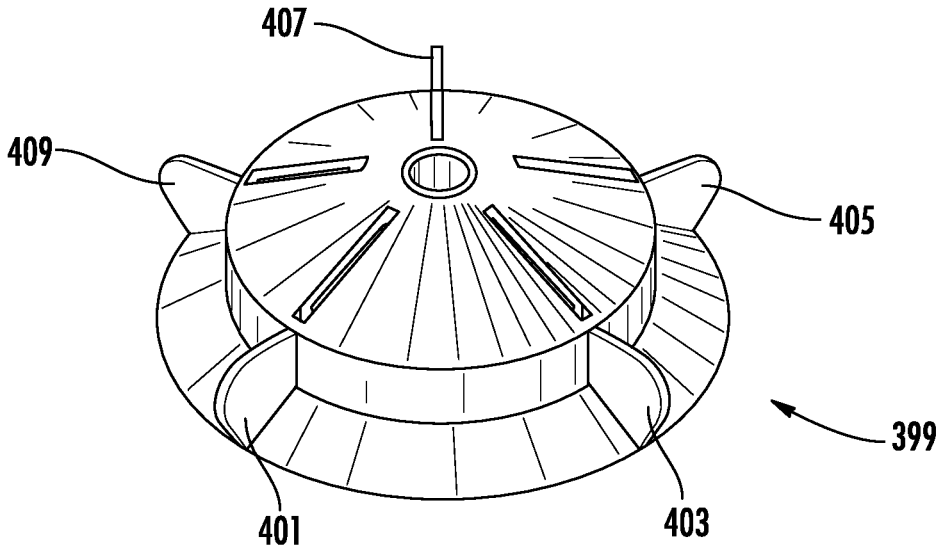
FIG. 9 illustrates a separate drive cone having five fins in a third alternate embodiment of the present invention.

The improved drive cone 99 only requires one fin 101. However, in alternate embodiments of the present invention, the drive cone 99 may have more than one fin. FIG. 7 illustrates a separate drive cone 199 having three fins 201, 203, and 205 in a first alternate embodiment of the present invention. FIG. 8 illustrates a drive cone 299 having four fins 301, 303, 305, and 307 in a second alternate embodiment of the present invention. FIG. 9 illustrates a separate drive cone 399 having five fins 401, 403, 405, 407, and 409 in a third alternate embodiment of the present invention. It should be understood that the drive cone may have any number of fins which allows the accommodation of more than one paintball within each formed gap. In addition, the drive cone may be used on a wide variety of paintball loaders.

In the preferred embodiment of the present invention, the paintball loader 40 may include a microprocessor 82 (FIG. 1) to enhance the performance of the loader 40 as well as providing useful information to a paintball gun 20 operator (not shown). The microprocessor 82 also deactivates the drive motor 70 when the exit tube 52 is full. The microprocessor 82 is attached to or in communication with the motor actuator switch 83 (FIG. 3) and is attached to or in communication with the motor 70 (FIG. 1). When the motor actuator switch 83 detects the presence of a paintball at the top of the exit tube 52, the motor actuator switch 83 sends a signal to the microprocessor 82. In turn, the microprocessor 82 sends a signal to disengage the motor 70. When the motor actuator switch 83 does not detect any paintballs 68 within the exit tube 52, the motor actuator switch 83 signals the microprocessor 82 that the exit tube 52 is empty. The microprocessor 82 can then signal the motor 70 to engage and rotate the drive cone, providing additional paintballs 68 to the paintball gun 20.

To remove jams, the drive cone 56 may be reversed by the motor 70. The curvature of the fins tends to push the paintballs upward and inward toward the top of the cone when the cone is rotated in reverse.

In the preferred embodiment, the microprocessor 82 may also be used to monitor jams within the paintball loader. The microprocessor may momentarily reverse the direction of rotation of the motor 70 in response to a jam. A jam may be detected, for example, when a specified increase in torque output from the motor occurs. If paintballs jam within the paintball loader, the drive motor experiences additional resistance in rotating the drive cone. This produces increased torque on the motor and a rise in electrical current. This rise is detected by a motor controller which may be, for example, the microprocessor 82. Upon detection of the rise in electrical current, the microprocessor immediately stops the motor to prevent jamming of a paintball within the exit tube. The microprocessor automatically commands the motor to start up after the jam clears. The microprocessor may be attached to the motor 82 or in any position which allows communication with the motor. When the electro-mechanical switch, or other any other type of sensor, detects the presence of a paintball at the top of the exit tube, the sensor sends a signal to the microprocessor. In turn, the microprocessor sends a signal to disengage the motor. When the motor actuator switch does not detect any paintballs within the exit tube, the sensor signals the microprocessor that the exit tube is not full. The microprocessor can then signal the motor to engage and rotate the drive cone, providing additional paintballs to the paintball gun.

The microprocessor may also perform the function of variably controlling the speed of the motor and the rotational speed of the drive cone. In conjunction with a sensor (electro-mechanical actuator switch, infrared sensor, etc.) within the exit tube 52, the microprocessor varies the speed of the motor to support the demand for paintballs. For example, if the exit tube is not full, more paintballs need to be supplied for entry into the paintball gun. The microprocessor then sends a command to the motor to increase the RPM, thus increasing the supply of paintballs to the gun. If the exit tube is full, as detected by the sensor, the motor is stopped by the microprocessor. As the demand for paintballs increases, the microprocessor commands the incremental increase in power to the motor, resulting in an increase in RPM of the drive cone. In existing devices, there are only two speeds associated with the motor, full speed or zero speed. With the use of the microprocessor, the motor can be variably controlled to supply paintballs according to the demand of the gun operator. The use of the microprocessor to variably control the speed of the motor may be utilized on any paintball gun loader requiring the use of a motor to feed paintballs to the paintball gun.

In the preferred embodiment of the present invention, the microprocessor changes the speed of the motor by varying the duty cycle available to the motor 82, rather than changing the voltage delivered to the motor. The duty cycle available to the motor is varied by pulse width modulation, which is a technique well known in the art of electronics. For example, the duty cycle is increased to increase the speed of the motor. Likewise, the duty cycle is decreased by the microprocessor to decrease the speed of the motor. The power utilization of the motor is more efficient by utilizing pulse width modulation to vary the speed of the motor. With low power remaining in a battery, which may be sensed by the microprocessor, the duty cycle may be decreased. This decrease in duty cycle available to the motor allows a battery to provide power to the motor for a longer period of time. Additionally, by utilizing pulse width modulation, any dc electrically powered motor may be used. Thus, an expensive variable speed motor is not necessary to operate the paintball loader 40.

The paintball loader 40 also provides the advantage of variably controlling the feed rate of the paintballs to the paintball gun. In existing paintball loaders, the motor driving the agitating device has only two speeds, full speed and zero speed. The paintball loader 40 provides a full range of speeds of the motor to change the speed at which the paintballs are delivered to the paintball gun. A sensor or plurality of sensors within the exit tube provide the microprocessor information when the demand. increases for paintballs, as indicated by an empty or half full exit tube. The microprocessor and sensor located within the exit tube may be used in any paintball loader, thus providing variable feed rates to the paintball gun.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A projectile loader comprising a motor configured to be operated at different speeds, a sensor in communication with the motor, and a projectile feeder operable by the motor, wherein a speed of the motor while running is configured to be automatically changed in response to a signal from the sensor.

2. The projectile loader of claim 1, wherein the signal is configured to be transmitted in response to a demand for paintballs.

3. The projectile loader of claim 1, wherein the speed of the motor is configured to be increased or decreased and remains greater than zero.

4. The projectile loader of claim 1, wherein the motor speed is configured to be changed through a range of speeds greater than zero.

5. The projectile loader of claim 1, wherein the motor is configured to be stopped in response to a detection of resistance to feeding projectiles.

6. The projectile loader of claim 1, wherein the motor is configured to be momentarily reversed in response to a detection of resistance to feeding projectiles.

7. The projectile loader of claim 1, wherein the motor is configured to be reversed or stopped in response to a detection of an increase in torque output from the motor.

8. A method of operating a projectile loader having a motor and a projectile feeder operable by the motor, comprising the steps of:

operating the motor;

transmitting a signal from a sensor to the motor; and, automatically changing a speed of the operating motor in response to the signal.

9. The method of claim 8, further comprising detecting the projectile feeder is restricted from moving, and reversing or stopping the motor in response to such detection.

10. The method of claim 8, further comprising reversing the motor in response to detecting resistance to feeding projectile.

11. The method of claim 8, further comprising increasing or decreasing the speed, and wherein the speed remains greater than zero.

12. The method of claim 8, wherein the signal is configured to be transmitted in response to a demand for paintballs.

13. The method of claim 8, further comprising changing the speed of the motor through a range of speeds greater than zero.

14. The method of claim 8, further comprising stopping the motor in response to a detection of resistance to feeding projectiles.

15. The method of claim 8, further comprising momentarily reversing the motor in response to a detection of resistance to feeding projectiles.

16. The method of claim 8, further comprising reversing or stopping in response to a detection of an increase in torque output from the motor.

* * * * *